US006115999A

United States Patent [19]

Adelman

[11] Patent Number: 6,115,999

[45] Date of Patent: Sep. 12, 2000

[54] METHOD OF FORMING A GIFT WRAP ARTICLE

[75] Inventor: Robert W. Adelman, Newark, Del.

[73] Assignee: The Crowell Corporation, Newport, Del.

[21] Appl. No.: 09/234,164

[22] Filed: Jan. 21, 1999

[51] Int. Cl.[7] ..... B65B 9/06; B65B 11/08; B65B 11/50

[52] U.S. Cl. ..... 53/465; 53/449; 53/450; 53/461; 53/472

[58] Field of Search ..... 53/465, 461, 460, 53/455, 449, 172, 450, 472, 550, 553

[56] References Cited

U.S. PATENT DOCUMENTS

| | | | |
|---|---|---|---|
| 2,449,334 | 9/1948 | Smith | 53/461 |
| 2,911,774 | 11/1959 | Frank et al. | 53/172 X |
| 4,086,384 | 4/1978 | Adelman et al. | 428/213 |
| 4,601,157 | 7/1986 | Adelman | 53/450 |
| 4,823,945 | 4/1989 | Adelman | 206/204 |
| 4,864,802 | 9/1989 | D'Angelo | 53/450 |
| 5,155,973 | 10/1992 | Hipko et al. | 53/460 X |
| 5,273,361 | 12/1993 | Jillson | 383/93 |
| 5,456,062 | 10/1995 | Wechsler | 53/461 X |
| 5,671,593 | 9/1997 | Ginestra et al. | 53/465 X |

*Primary Examiner*—James F. Coan
*Attorney, Agent, or Firm*—Connolly, Bove Lodge & Hutz, LLP

[57] ABSTRACT

A gift wrap article is formed by providing wrapping material which is padded and waterproof. The inner surface of the wrapping material has a cohesive coating, while the outer surface has a layer of gift wrap decorative design. The article is placed on a portion of the inner surface of the wrapping material and the wrapping material is applied over the article so that the article is between and completely surrounded by two layers of the wrapping material. The layers of the wrapping material are squeezed together to cohesively secure the inner surfaces of the two layers together and form a closed package with the article within the package and with the gift wrap outer layer visually exposed.

12 Claims, 1 Drawing Sheet

METHOD OF FORMING A GIFT WRAP ARTICLE

BACKGROUND OF THE INVENTION

Conventionally, when it is desired to gift wrap an article, the article is either placed in a box or other container and thin gift wrap paper is wrapped around the box or container or wrapped directly around the article. When it is desired to mail the article, it is then necessary to place the gift wrapped article within a further package or to apply an outer wrapping suitable for mailing purposes.

It would be desirable if the article could be gift wrapped with a material which is capable of functioning not only as a decorative gift wrap for the article, but also as the mailing or protective material itself.

SUMMARY OF THE INVENTION

An object of this invention is to provide a method which results in a gift wrapped article using a combination of known materials.

A further object of this invention is to provide such a method wherein the gift wrapping could be accomplished in a simple and convenient manner and result in a package capable of mailing.

In accordance with this invention use is made of a known wrapping material which could be used for mailing purposes by taking advantage of its properties of being padded and waterproof. The wrapping material advantageously has a cohesive inner surface so that when the article is placed between two layers of the material, the two layers could be pressed together to form a closed package. In accordance with this invention the outer layer of the wrapping material is provided with a visible layer of gift wrap decorative design so that the wrapped package is not only decoratively wrapped in the appearance of a gift wrapped package, but is also capable of functioning as a mailing unit.

In one practice of the invention the wrapping material is manually applied by either folding a sheet of material around the article or by placing the article between two separate sheets and then pressing the portions of the sheets together peripherally around the article. Alternatively, the wrapping may be accomplished in an automated manner by known wrapping machinery.

THE DRAWINGS

DETAILED DESCRIPTION

Figure 1:
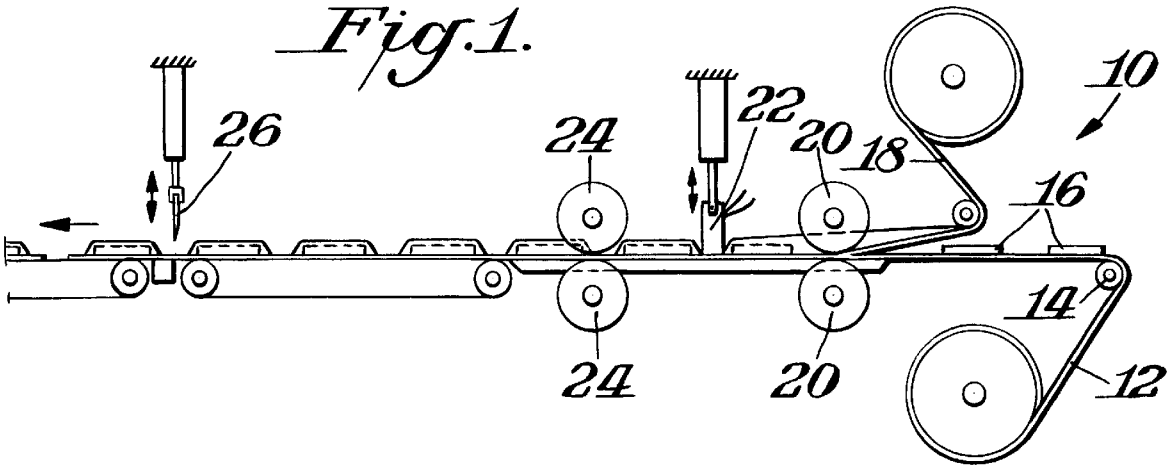
FIG. 1 is a schematic side elevational view of a machine which is used for applying the gift-wrap material in accordance with one practice of this invention.

The present invention is based upon the recognition that there is in existence wrapping material which fulfills the functions needed to form a package that may be transported through the mail, such as through the postal service or commercial services such as UPS, etc. A preferred form of this known material is CRO-NEL, a registered trademark of the Crowell Corporation for wrapping material. Such material has been used as a versatile paper/foam packaging material consisting of closed-cell foam laminated to kraft or linerboard which may be reinforced and which is preferably cohesively coated on the foam or inner surface. Wraps or pouches are easily formed when the cohesive surfaces are pressed together. The cohesive surface advantageously will adhere only to itself and not to the article being packaged. Wraps or pouches formed from such material are waterproof, greaseproof, padded and completely sealed. No supplementary closure material is required.

By varying the thickness of the foam and/or the grade of kraft or linerboard backing the material can be constructed with a wide range of strength and cushioning characteristics. Foam thicknesses, for example, may be 1/16 inch, 3/32 inch and 1/8 inch combined either with a 30 lb. or 60 lb. kraft backing or a 42 lb. or a 69 lb. kraft linerboard substrate. A variation of the material is CRO-NEL PLUS which is a trademark of the Crowell Corporation for a plastic film/foam laminate. A further suitable material is NYVEL which is a registered trademark of the Crowell Corporation for cohesive coated sheet material. NYVEL is similar to CRO-NEL but omits the foam which provides cushioning and waterproofness.

The material may be supplied in either sheets or rolls. Specialized protective packaging functions can be enhanced through the use of foil and other substrates, as well as special coatings and treatments. Such material has been made with white mottled, or colored kraft and printed in various colors to enhance aesthetic appeal. Such material has also been used to provide advertisement or other informational literature on the outer surface.

Despite the uses of such material, it has heretofore not been used as an outer wrap having gift wrap decorations to permit the resultant package to have the aesthetic appearance of a gift wrapped packaged. The uses that have been made of the CRO-NEL material have been broadly applied in the packaging field because of its exceptional packaging performance characteristics. These advantageous properties of the material include the material being padded, having a cohesive or adhesive coating, being reinforced as with tough, tear-resistance fiber glass, being tampered evident when the cohesive seal is destroyed in opening, being an effective thermal insulator, being lightweight, being non-corrosive, being effective packaging where product separation is needed, being moisture resistant, being vapor resistant through the addition of foil substrate, providing excellent grease resistant, providing excellent abrasion resistance with a high coefficient of friction, being dust and lint proof, being tarnish resistant, having the characteristics of not supporting growth of mildew or fungus and being capable of having characteristics such as anti-stat and VCI treated grades available for special packaging problems.

As previously noted because of its versatility CRO-NEL has found wide application as protective packaging for applications ranging from the wrapping of coils or sheets of steel or aluminum to the protection of the bark of young trees. The material has provided surface protection for most surfaces including wood, painted wood, metal, painted metal and even including fuselage and wing sections of aircraft. The material has had interleaving applications for polished metal parts and for the shipment of empty prelabeled glass and plastic bottles. The material has also had interior packaging as a protective wrap for bottled liquids within a box to contain possible spills for glassware, chinaware, pottery, etc. The present invention makes use of the ability of the material to function as a shipping container, as an economical replacement for preformed bags, envelopes, die-cut mailers and boxes for the shipment of various items such as books, albums, cassettes, recording tapes, ties, wallets, samples, premiums, spare parts, hardware and hundreds of other items.

Use has been made of automated packaging machines for wrapping the CRO-NEL material without the need for manual packaging. For example, the Crowell Corporation provides a CRO-NEL packer or pouch packaging system. Reference is made to U.S. Pat. Nos. 4,086,384, 4,601,157, 4,823,945, and 4,864,802 for a description of such material and automatic packaging machine. All of the details of those patents are incorporated herein by reference thereto. It is to be understood, however, that the reference to the CRO-NEL material and its associated packaging machines is for purposes of describing the preferred practices of this invention. The invention, however, may be practiced with other materials having the characteristics of providing sufficient padding and being capable of being secured to itself to form a package which preferably is waterproof and can be sealed around its periphery to completely seal the article therein.

FIG. 1 schematically illustrates an automated packaging machine 10 which may be used in the practice of this invention. As shown therein, machine 10 provides a first layer 12 of wrapping material which moves over roller 14. The individual articles 16 would be placed at spaced intervals on layer 12. A further supply for a second layer 18 of wrapping material is provided to overlay the article 16 and lower layer 12. The combined layers 12,18 then pass through press rolls 20 to provide for side seals to the package being created. Cross-seals could be formed from unit 22 between spaced articles. If desired, further side roll assemblies 24 may also be provided downstream for unit 22. A cutting assembly 26 then separates each assembly into individual packages.

Figure 2:
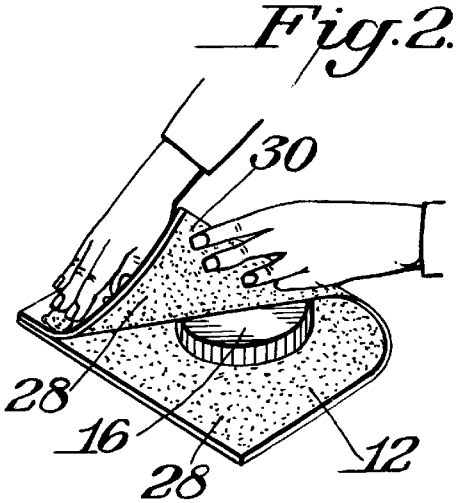
FIG. 2 is a perspective view showing the article being manually wrapped in accordance with an alternative form of this invention.

FIG. 2 illustrates an alternative practice of the invention wherein an article 16 is placed on the inner surface 28 of wrapping material 12 with the material 12 then being folded so that the upper layer 30 is part of the same sheet of material 12. As illustrated in FIG. 2 the inner surface 28 has a cohesive layer so that a package is formed. If a person presses the two layers of material together around the periphery of article 16, a closed package results which is sealed by the inner surfaces 28,28 being secured together without adhering to the article 16. In the broad practice of this invention where it is not critical to keep the wrapping material distinct from the article, an adhesive layer may be used on the inner surface.

Figure 3:
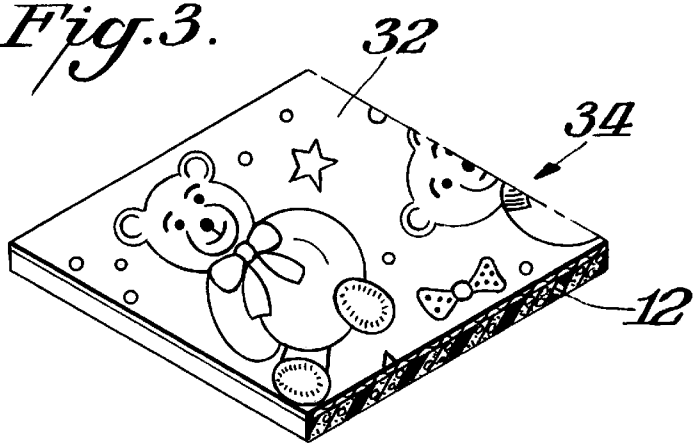
FIG. 3 is a fragmental perspective view showing the gift-wrap material.
Figure 4:
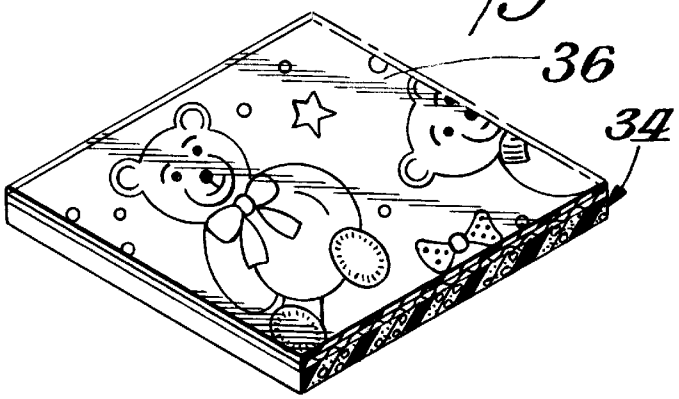
FIG. 4 is a view similar to FIG. 3 of an alternative form of material.

A significant feature of the invention is best shown in FIGS. 3–4 which illustrate material 34. As indicated therein the material 34 includes a layer 12 made, for example, of CRO-NEL. The outer surface 32 of layer 12 has a decorative wrap design. Such design could, for example, be the same as decorative wrap conventionally used for various occasions such as holidays, birthdays, anniversaries, etc. The design may be applied as a separate layer to the outer surface of foam padded layer 12. The decorative design 32 would be exposed as the outside layer at both the front and back sides of the finished package 34.

FIG. 4 illustrates a variation of the invention wherein an outer transparent film layer 36 is provided over decorative wrap material 34 to provide extra protection for the package and if desired to provide luster to the package.

Once a package is formed either manually (as in FIG. 2) or in an automated manner (as shown in FIG. 1), the package may be used for mailing purposes by providing an address label and postage on the package. The invention is particularly advantageous by eliminating the need for two separate wrappings, one for gift-wrap purposes and the other for mailing purposes. The use of automated gift-wrapping as in FIG. 1 would be particularly useful, for example, for catalog houses where gifts are supplied by mail after being ordered through a catalog or from a store where a gift is supplied after the order is taken.

The invention also lends itself to being used by the ultimate consumer where the gift wrap material 12 would be sold in sheets or rolls to end users who would then form the finished mailing gift-wrap package in the manner of FIG. 2. Advantageously the final mailing gift wrap package is formed without the need for strings, cords or wrapping tape which would detract from the aesthetic appearance of the gift wrapped package.

The invention thus makes use of material having known packaging characteristics by modifying that material to provide an outer visible gift-wrap appearance so that a gift does not require an additional layer of wrapping material when the gift is being sent through the mail. It is to be understood that as used herein the reference to being sent through the mail is intended to apply both to governmental and commercial "mailing" services.

Gift-wrapping has become a large business which is not only very expensive but is also labor intensive. A store, for example, might charge an amount of about $8.00 to gift-wrap a purchased item. Additional cost is incurred when it is necessary to mail the gift-wrapped item by requiring some outer container which would protect the gift-wrapped item. The present invention significantly reduces these costs by making a package for mailing purposes simultaneously with the gift-wrapping. Because it is not necessary to use conventional wrapping accessories such as string, tape, etc. the wrapping could be done by the customer or could be done at reduced or no cost as a service by the store. The provision of a film laminate such as layer 36 on top of the outer surface makes the package even stronger and scuff resistant for shipping and mailing purposes. It is to be understood that while the forming of a package capable of being mailed is a significant advantage of the invention, the invention may also be practiced without an actual mailing step. Thus, for example, a gift giver would be assured that the gift is not only gift-wrapped, but is also gift-wrapped in an effective protective manner even where the giving is done personally and not through a mailing service.

What is claimed is:

1. A method of packaging an article consisting of providing a wrapping material having an inner surface and an outer surface, the wrapping material being in the form of a multilayer laminate comprising a high strength support layer having an inner surface and an outer surface, the laminate including an exposed cohesive layer coating mounted to the inner surface of the support layer, the cohesive layer being the inner surface of the wrapping material, the laminate further including a layer of gift wrap decorative design on the outer surface of the support layer, placing the article on a portion of the inner surface of the wrapping material, applying the wrapping material over the article so that the article is between and completely surrounded by two layers of the wrapping material, pressing the two layers of wrapping material together with their cohering inner surfaces against each other to secure the inner surfaces of the two layers of wrapping material together without adhering to the article to thereby form a closed package with the article within the closed package, and having the gift wrap decorative design layer visually exposed and thereby create a gift wrapped package capable of being mailed without any other outer wrapping material and without other fastening material to maintain the packaged wrapped.

2. The method of claim 1 wherein the adhering coating is cohesive and the step of pressing the two layers of wrapping material together forms a peripheral sealed package without the inner surfaces adhering to the article.

3. The method of claim 2 including the step of applying mailing details to the outer surface.

4. The method of claim 3 wherein the two layers of the wrapping material are formed from a single sheet folded upon itself.

5. The method of claim 4 wherein the pressing is done manually.

6. The method of claim 3 wherein the pressing is done by automated machinery.

7. The method of claim 1 including providing an outer transparent layer over the layer of gift-wrap decorative design.

8. The method of claim 1 including the step of applying mailing details to the outer surface.

9. The method of claim 7 wherein the two layers of the wrapping material are formed from a single sheet folded upon itself.

10. The method of claim 9 wherein the pressing is done manually.

11. The method of claim 8 wherein the pressing is done by automated machinery.

12. The method of claim 1 wherein wrapping material is waterproof and contains cushioning foam to further protect the article.

* * * * *